US006442825B1

(12) United States Patent
Pomerantz

(10) Patent No.: US 6,442,825 B1
(45) Date of Patent: Sep. 3, 2002

(54) LAPPING AND POLISHING FIXTURE HAVING FLEXIBLE SIDES

(75) Inventor: Glenn A. Pomerantz, Kerhonkson, NY (US)

(73) Assignee: International Business Machines Corporation, Armonk, NY (US)

( * ) Notice: Subject to any disclaimer, the term of this patent is extended or adjusted under 35 U.S.C. 154(b) by 328 days.

(21) Appl. No.: 09/457,730

(22) Filed: Dec. 10, 1999

Related U.S. Application Data

(62) Division of application No. 09/111,303, filed on Jul. 7, 1998, now Pat. No. 6,152,807.

(51) Int. Cl.[7] ..... B23P 13/04; B23Q 7/00

(52) U.S. Cl. ..... 29/558; 29/559; 451/286

(58) Field of Search ..... 451/286, 287, 451/385, 397, 398; 269/47, 900, 254 R; 29/558, 559, 281.1

(56) References Cited

U.S. PATENT DOCUMENTS

| | | | | |
|---|---|---|---|---|
| 2,398,906 A | | 4/1946 | McCain | |
| 2,740,237 A | | 4/1956 | Day et al. | |
| 2,869,294 A | | 1/1959 | Boettcher et al. | |
| 3,453,783 A | | 7/1969 | Queen | |
| 3,867,797 A | | 2/1975 | Meier | |
| 4,081,928 A | | 4/1978 | Kinnebrew et al. | |
| 4,193,588 A | * | 3/1980 | Doneaux | 269/47 |
| 4,239,567 A | * | 12/1980 | Winings | 156/154 |
| 4,512,113 A | | 4/1985 | Budinger | |
| 4,703,920 A | * | 11/1987 | Grabbe et al. | 269/254 R |
| 4,780,991 A | | 11/1988 | Gosis | |
| 4,810,616 A | * | 3/1989 | Grabbe et al. | 269/254 R |
| 5,121,572 A | | 6/1992 | Hilscher | |
| 5,193,316 A | | 3/1993 | Olmstead | |
| 5,267,418 A | | 12/1993 | Currie et al. | |
| 5,533,924 A | | 7/1996 | Stroupe et al. | |
| 5,643,064 A | | 7/1997 | Grinderslev et al. | |
| 5,882,245 A | * | 3/1999 | Popovich et al. | 451/288 |
| 5,996,985 A | * | 12/1999 | Balz et al. | 269/254 R |
| 6,017,025 A | * | 1/2000 | Balz et al. | 269/254 R |
| 6,030,280 A | * | 2/2000 | Fruitman | 451/398 |
| 6,042,688 A | * | 3/2000 | Masumura et al. | 451/287 |

* cited by examiner

*Primary Examiner*—S. Thomas Hughes
*Assistant Examiner*—Marc Jimenez
(74) *Attorney, Agent, or Firm*—McGinn & Gibb, PLLC; Tiffany L. Townsend, Esq.

(57) ABSTRACT

A fixture for holding a workpiece in a machining apparatus comprises at least one opening having at least one flexible side for elastically holding the workpiece and a slot adjacent each of the at least one side for allowing the side to flex.

9 Claims, 4 Drawing Sheets

LAPPING AND POLISHING FIXTURE HAVING FLEXIBLE SIDES

This is a divisional of application Ser. No. 09/111,303 filed on Jul. 7, 1998, now now U.S. Pat. No. 6,152,807.

BACKGROUND OF THE INVENTION

1. Field of the Invention

The present invention generally relates to fixtures for holding workpieces during lapping and polishing operations and more specifically to an improved fixture which accommodates different sized workpieces.

2. Description of the Related Art

Ceramic substrates routinely go through a process of lapping and/or polishing, after they have been fired, to achieve desired flatness, roughness and thickness specifications. These processes involve the fixturing of the substrate in a dressing wheel or polishing head which is then turned on a spinning table upon which abrasive slurries are applied.

FIG. 1 illustrates a conventional double-sided lapping machine. Motor 1 turns gearbox 2 to drive an upper dressing/working wheel 3. Similarly, motor 8 turns gear box 9 to drive a lower dressing/working wheel 7, via a belt 10. A workpiece to be lapped (not illustrated) is placed in a fixture (not illustrated), between two working wheels 3 and 7. Motor 4 and belt 6 turn gear box 5 to drive a workpiece drive 11.

A large wheel 20 (shown in FIG. 2), typically made of spring-steel that contains round openings 21, is mounted on the workpiece drive 11. The workpiece drive 11 turns the large wheel 20. Plastic fixtures 22 (e.g., disks) are inserted into these round openings 21. It is these fixtures 22 that are the subject of this invention.

FIG. 3 shows a conventional fixture 30 that holds two ceramic substrates 40 (FIG. 4) for lapping or polishing in separate openings 31. The fixture 30 holds the substrate 40 in place and must be fabricated to fit the individual substrates 40. The fixture 30 can be made of any machinable material, such as polyvinyl chloride (PVC), plastic or metal.

The fixture 30 must be thinner than the workpiece or substrate 40 and thin enough to allow for sufficient removal of material from the workpiece 40. Openings 31 are typically fabricated to a tolerance of −0.000"/+0.005" of the overall length 41 and width 42 of the workpiece 40 to be lapped or polished. This tolerance is required to minimize the amount of movement within the opening 31. Too much movement results in chipping of the workpiece edges during lapping and polishing.

If the opening 31 in the fixture 30 is too small, the substrate 40 will not fit inside the fixture 30. If the opening 31 in the fixture 30 is too big, the substrate 40 will move around too much and will result in "chipping" on the substrate.

This invention solves the problem that occurs when the length 41 and width 42 of the substrate 40 varies more than the tolerance of the fixtures 30. This usually occurs when the workpiece 40 is to be lapped and/or polished after sintering. In other words, the length 41 and/or the width 42 of the workpiece 40 commonly varies by more than 0.005".

Conventional solutions to this problem include a sizing operation between sintering and lapping or polishing. In this manner, all parts (e.g., substrates 40) would be accurately cut to fit the opening 31. However, this is an expensive solution. Another conventional solution is making multiple sized openings 31 and "best fitting" the parts 40 to the openings 31. However, this process is time consuming and difficult.

SUMMARY OF THE INVENTION

It is, therefore, an object of the present invention to provide a structure and method for the fabrication of curved flexures built into the fixture that maintain contact with the workpiece at all times. Any movement within the fixture will be dampened by the flexure.

The flexures can be adjusted for different dampening strengths. The flexures can also provide a single contact point with the workpiece sides or multiple contact points. The flexures can be fabricated using typical machining or punching methods.

More specifically, the invention includes a fixture for holding a workpiece in a polishing/lapping apparatus. The fixture comprises at least one opening having at least one curved flexible side for elastically holding the workpiece and a slot adjacent each curved flexible side for allowing the side to flex.

The slot has a length approximately equal to that of the side and a shape approximately equal to that of the side. An amount of travel of the side is controlled by a width of the slot.

The invention also includes a web positioned between the side and the slot, wherein a tension of the side against the workpiece is controlled by a width of the web.

The side is curved toward a center of the opening such that the workpiece contacts the side only at a distinct point. The side can also be a multiple-curve side having at least two curves, such that one distinct point on each curve of the at least two curves touches a same side of the workpiece. The opening can be a four-sided opening having a first number of the curved flexible sides and a remaining number of straight sides. The fixture can comprise one of a plastic, polyvinyl chloride, metal or other suitable material.

The invention similarly includes an apparatus for machining a workpiece, the apparatus comprising a motor, a wheel turned by the motor, a fixture attached to the wheel and for holding a workpiece in the machining apparatus. The fixture comprises at least one opening having at least one curved flexible side for elastically holding the workpiece.

The invention also includes a method for producing a fixture for holding a workpiece in a machining apparatus, comprising steps of supplying a disk of material, forming at least one opening in the disk of material having at least one curved flexible side for elastically holding the workpiece. The invention similarly includes a method of machining a workpiece comprising forming a fixture for holding the workpiece in a machining apparatus, forming at least one opening in the fixture having at least one curved flexible side for elastically holding the workpiece, mounting the workpiece in the opening, elastically holding the workpiece, using the curved flexible side, in the opening and machining the workpiece while being held by the fixture.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF PREFERRED EMBODIMENTS OF THE INVENTION

Figure 5:
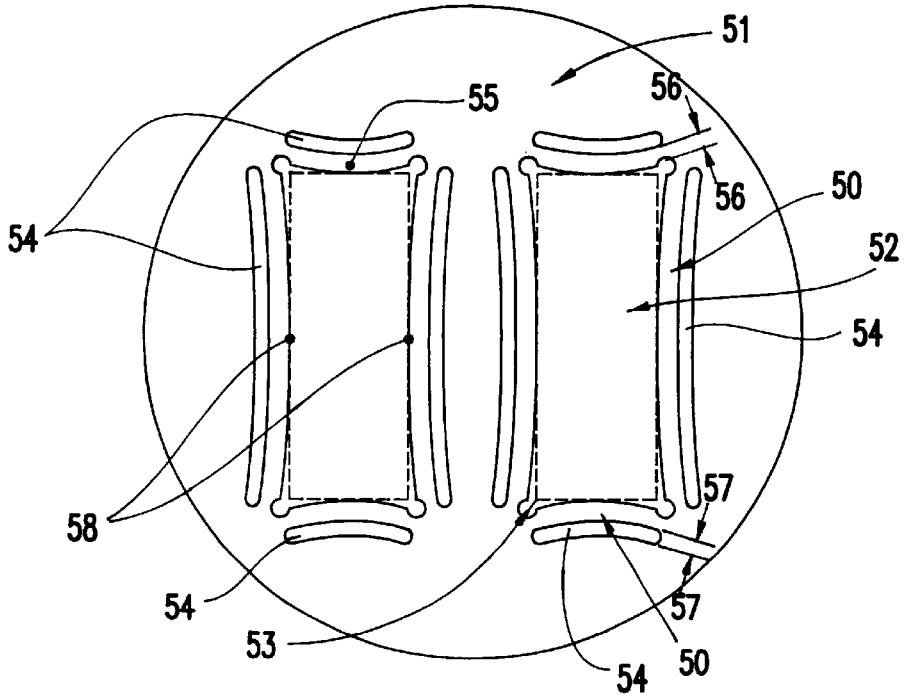
FIG. 5 is a schematic diagram of a fixture according to the invention.

Referring now to the drawings, and more particularly to FIG. 5, a first embodiment of the invention is illustrated. More specifically, the invention comprises an apparatus for accommodating varying size workpieces in a fixture of a lapping or polishing (e.g., machining) tool.

Figure 1:
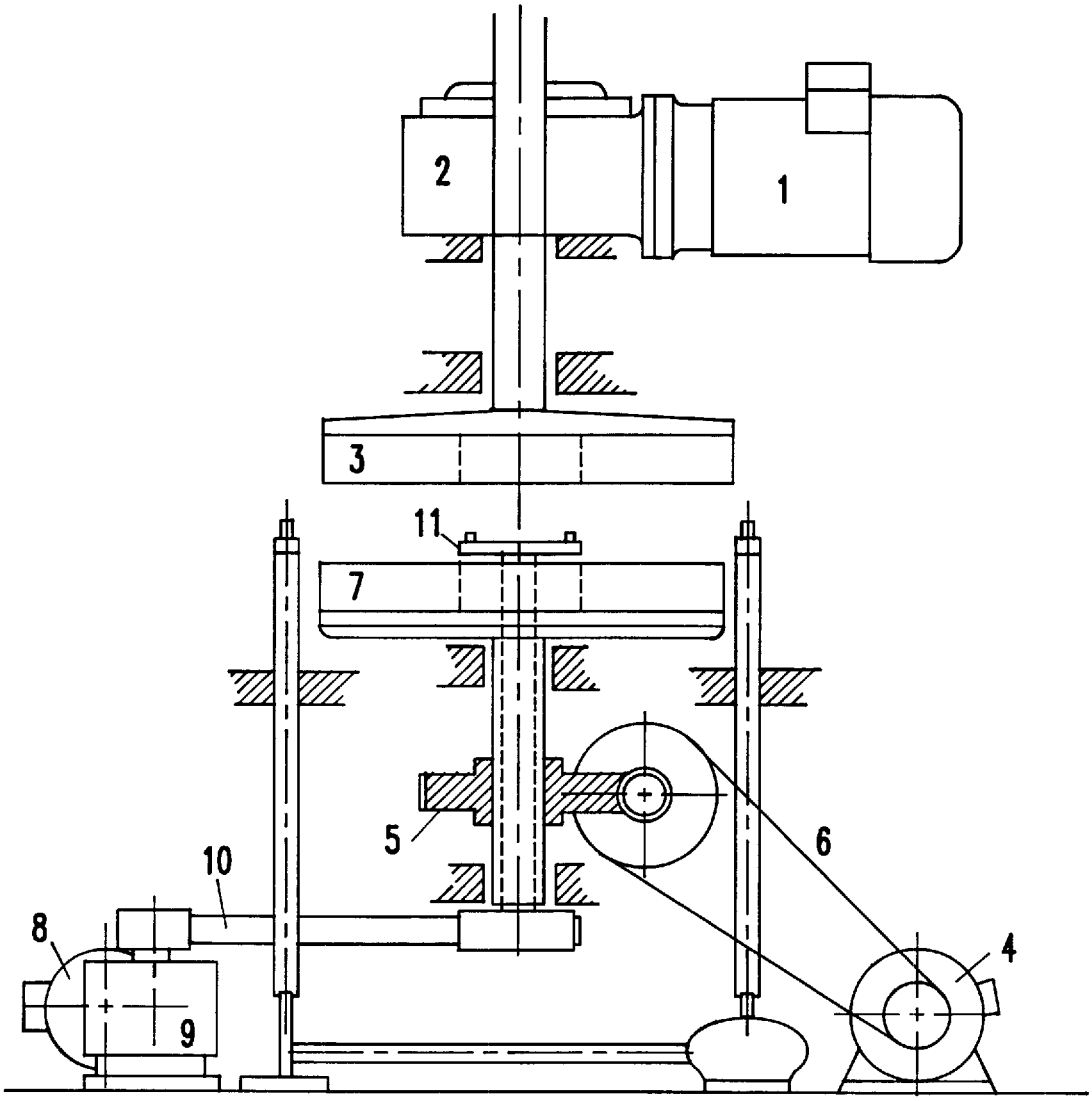
FIG.1 PRIOR ART
FIG. 1 is a schematic diagram of a conventional lapping/polishing machine.
Figure 3:
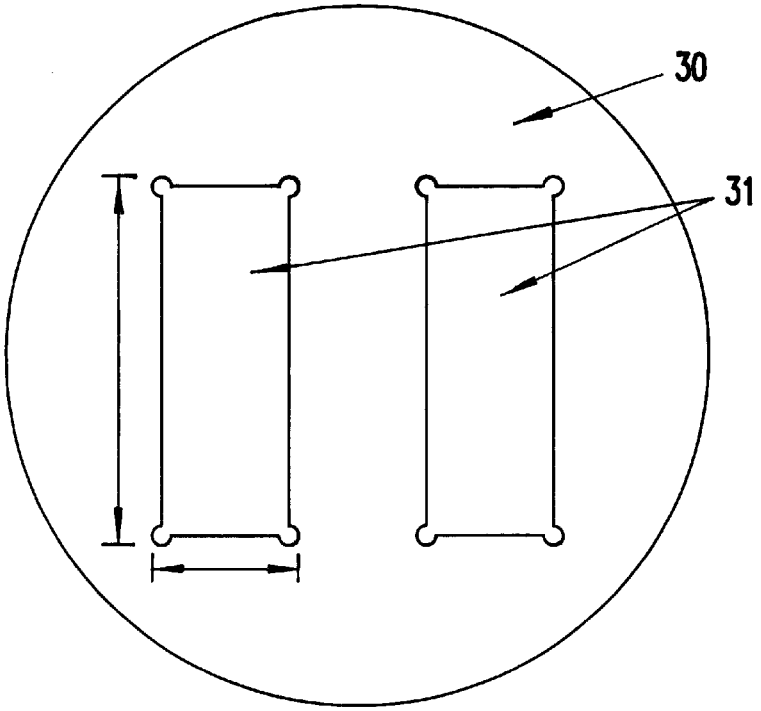
FIG.3 PRIOR ART
FIG. 3 is a schematic diagram of a conventional fixture.
Figure 2:
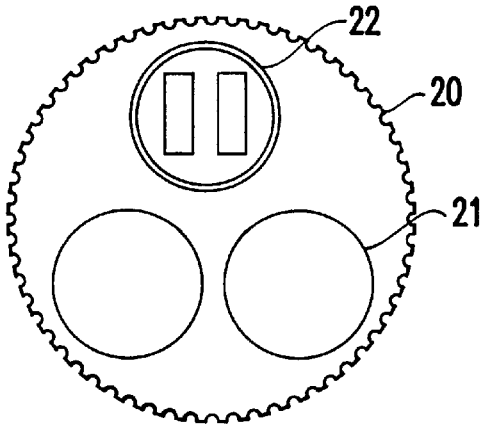
FIG.2 PRIOR ART
FIG. 2 is a schematic diagram of a conventional disk containing fixtures.
Figure 4:
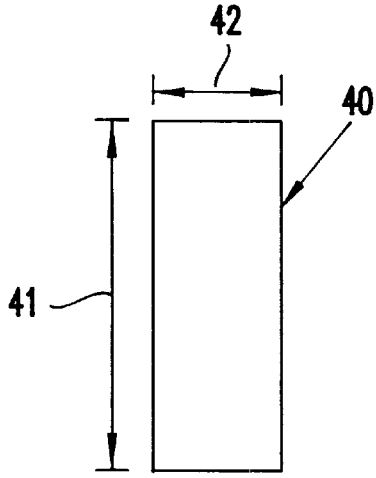
FIG.4 PRIOR ART
FIG. 4 is a schematic diagram of a conventional substrate.

As mentioned above, conventionally an opening is cut out of a plastic or PVC template to accommodate a workpiece 40, preferably rectangular shaped workpiece 40 (e.g., see FIGS. 3 and 4). The workpiece could be any device which is to be machined, such as a semiconductor device or substrate, or a ceramic device or substrate. Further, while preferred embodiments of the invention are discussed with respect to a rectangular workpiece, the invention is equally applicable to any shaped workpiece which is to be held in a grinding and or polishing apparatus. Therefore, the workpiece could be round, square, triangular, pentagonal, etc. The opening 31 is typically cut to −0.000"/+0.005" tolerance of the workpiece's outer dimensions (e.g., length 41 and width 42).

Referring now to FIG. 5, the inventive structure which accommodates workpieces whose length and width exceed the above mentioned tolerance is illustrated. More specifically, FIG. 5 illustrates flexures 50 which are fabricated into the fixture 51 which holds a workpiece 53. The inventive flexures 50 allow varying size workpieces to be held securely in the opening 52 of the fixture 51 during the lapping and polishing process and thus eliminate chipping.

More specifically, the flexures 50 comprise the wall of the opening 52, secondary openings 54, and an area between the secondary openings 54 and the wall of the opening 52 which is referred to as a "web" 55.

As illustrated in FIG. 5, the secondary openings 54 comprise slots within the fixture 51 that have about the same length and shape as each of the sides of the opening 52. The secondary openings 54 preferably extend completely through the fixture 51.

The flexures 50 have a surface which is curved toward the inside of the opening 52. Because of its curved shape, the flexure makes contact with the workpieces generally at one point 58.

The materials for forming a fixture 51, such as plastic or PVC, mentioned above, are generally flexible and, therefore, the curved shape of the flexure 50 is movable and can accommodate different sized workpieces 53.

The length and width of the fixture 51 are designed to accommodate the expected range of sizes of the workpieces 53. A workpiece 53 on the low end of its tolerance should fit easily into the opening 52 against the flexures 50 and be held in place by the flexure 50. A workpiece on the high end of the tolerance should "snap" into the opening 52 against the flexures 50 with minimal effort. The flexible nature of the flexures 50 varies the shape of the opening 52 to accommodate the different sized workpieces 53 and to hold the workpiece 53 in place.

The tension and the allowable travel of the flexures 50 is adjusted by several variables. The secondary openings 54 provide space for the web 55 to move. Therefore, the width 57 of the secondary openings 54 determines the distance that the web 55 portion of the flexures 50 can travel. The wider the secondary openings 54, the more the flexure 50 can travel.

Further, the width 56 of the web 55 affects the flexibility of the flexure 50. The wider the web 55, the stronger the spring force. Similarly, the flexibility of the material chosen for the fixture 51 effects of the flexibility of the flexure 50. The secondary openings 54 and the web 55 allow both the sides and the top and bottom of the fixture 51 to accommodate different lengths and widths of the workpieces 53.

In a preferred example, the opening 52 has a width of about 25 mm and a height of about 64 mm. The secondary openings 54 have a width 57 of about 1.588 mm and the web has a width 56 of about 3.175 mm. However, the invention is not limited to these dimensions and is useful for all workpieces which are subject to lapping and/or polishing.

The fixtures can be machined using conventional computer numeric controlled (CNC) milling machines or can be stamped/punched if high quantities of fixtures are needed. As would be known by one ordinarily skilled in the art given this disclosure, the inventive fixtures can be equally applied as fixtures for single sided lapping, double sided lapping, single sided polishing or double sided polishing.

Figure 6:
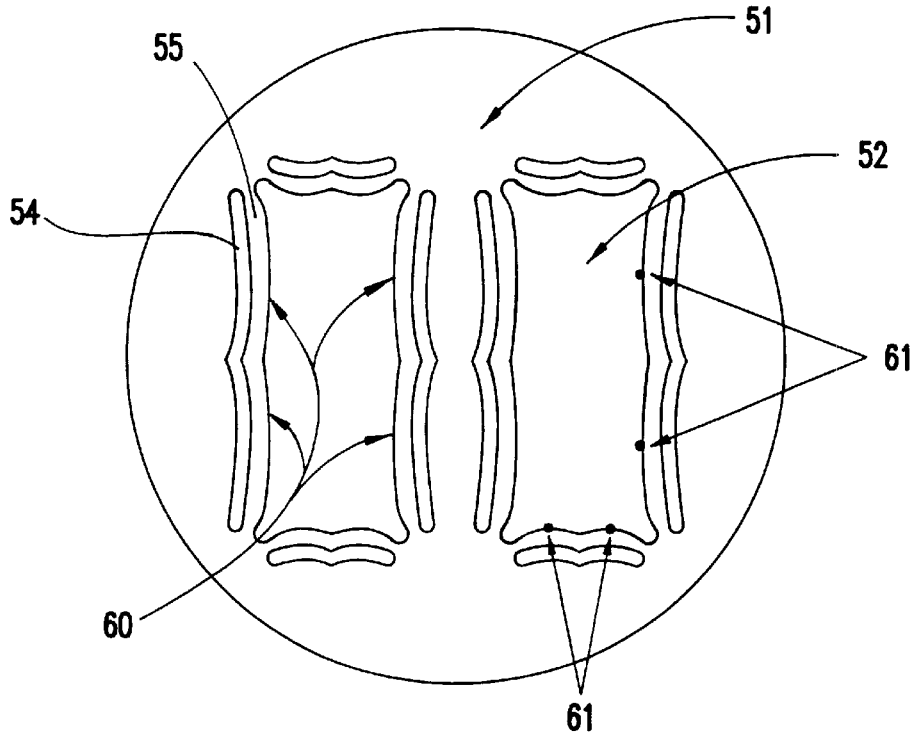
FIG. 6 is a schematic diagram of a fixture according to the invention.
Figure 7:
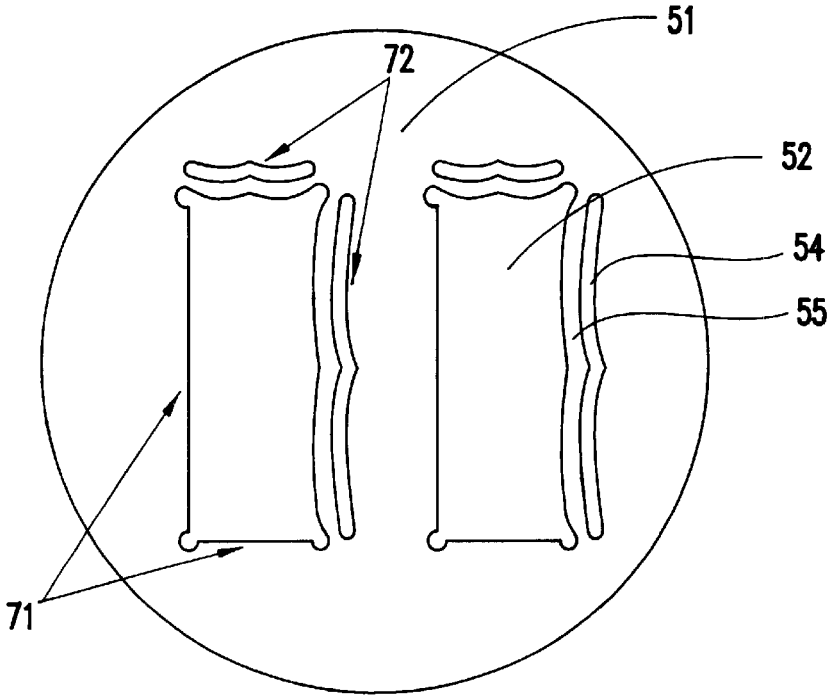
FIG. 7 is a schematic diagram of a fixture according to the invention.
Figure 8:
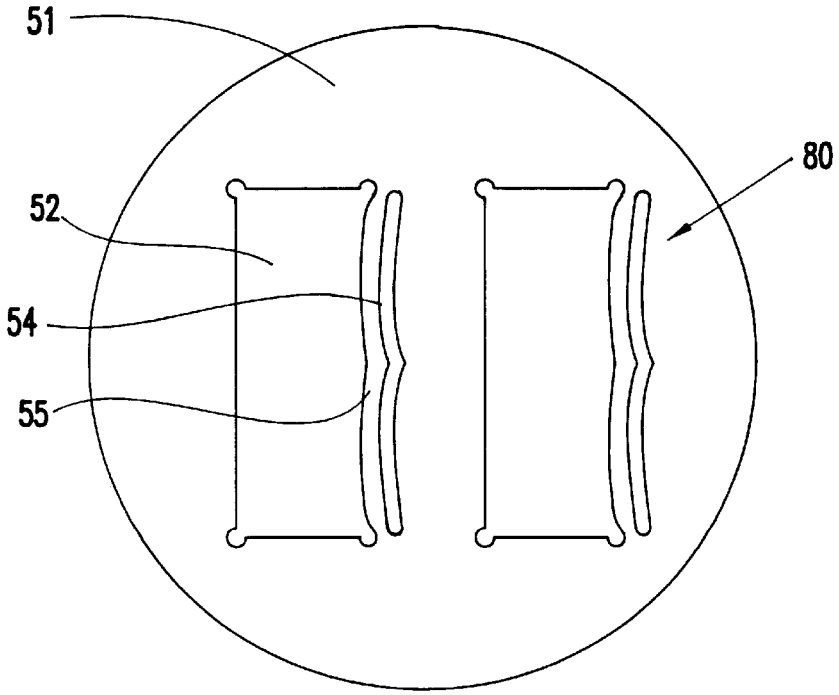
FIG. 8 is a schematic diagram of a fixture according to the invention.

The elements illustrated in FIGS. 6–8 are given the same identification numbers as the same structures shown in FIG. 5, and a detailed discussion of those structures is not repeated, for the sake of brevity.

The number of "leaves" (e.g., curves) per flexure also affects the spring force of the flexure. The flexures can be "single leaf", as shown in FIG. 5, or can have "multiple leaves" as shown in FIG. 6. The double leaf design (e.g., multiple-curve sides) shown in FIG. 6 maintains two contact points 61 per side.

As mentioned above, the single leaf flexure shown in FIG. 5 provides one contact point to the edge of the workpiece. To the contrary, a multiple leaf flexure 60 provides more than one contact point 61 with the workpiece (not illustrated for clarity). All other variables being equal, a single leaf fixture 50 has more spring force than a multiple leaf flexure 60 because the single leaf structure will have a longer moment arm (from a comer of the opening to the contact point), which will provide more spring force at the point of contact.

For added strength and reduced fabrication costs, other embodiments of the invention include only one or two flexures. For example, FIG. 7 illustrates an opening 52 with two straight sides 71 and two flexures 72. This embodiment of the invention provides essentially the same benefits as the four sided flexure design discussed above with respect to FIGS. 5 and 6. However, the fixture illustrated in FIG. 7 is stronger and is easier to machine because two of the sides do not include the secondary openings 54.

Similarly, for workpieces 53 that vary in only one direction, width for example, another embodiment of the invention includes an opening 52 with only one flexure 80, as illustrated in FIG. 8.

The above-described preferred embodiments of the invention are useful for most types of materials, such as ceramic substrates. The invention is equally useful with any item which undergoes any type of machining, regardless of shape and/or composition, as would be known by one ordinarily skilled in the art given this disclosure.

Therefore, as described above, the invention overcomes the problems associated with workpieces being too large or too small for openings within a fixture. The inventive flexures 50 accommodate workpieces of varying sizes and firmly hold the workpieces within the openings during the lapping and/or polishing processes.

Since the inventive fixtures are useful for different sized workpieces, the invention saves substantial time and production costs by allowing a uniform fixture to be utilized for a given production of workpieces. Further, the additional fitting process (i.e., matching workpiece and fixture) and the process of cutting the workpieces to fit the fixture (i.e., sizing process), which are required with conventional fixtures, are eliminated with the invention.

While the invention has been described in terms of preferred embodiments, those ordinarily skilled in the art will recognize that the invention can be practiced with modification within the spirit and scope of the appended claims.

I claim:

1. A method for producing a fixture for holding a workpiece in a machining apparatus, comprising:

forming at least one first opening in a disk of material, said first opening having at least one flexible side for elastically holding said workpiece; and forming a slot adjacent each of said at least one flexible side for allowing said flexible side to flex, wherein said slot comprises a second opening distinct from said first opening and said slot has a length approximately equal to that of said flexible side.

2. A method for producing a fixture as in claim 1, wherein said forming of said slot comprises forming said slot to have a shape approximately equal to that of said flexible side.

3. A method for producing a fixture as in claim 1, wherein said forming of said slot includes controlling an amount of travel of said flexible side by varying a width of said slot.

4. A method for producing a fixture as in claim 1, wherein said forming of said slot further comprises forming a web between said flexible side and said slot and controlling a tension of said flexible side against said workpiece by varying a width of said web.

5. A method for producing a fixture as in claim 1, wherein said forming of said first opening includes forming said flexible side to comprise a curved flexible side curved toward a center of said opening such that said workpiece contacts said flexible side at an approximate mid-point.

6. A method for producing a fixture as in claim 1, wherein said forming of said first opening includes forming said flexible side to be a multiple-curve side.

7. A method for producing a fixture as in claim 6, wherein said forming of said flexible side to be a multiple-curve side comprises forming said flexible side to have at least two curves, such that an approximate mid-point on each curve of said at least two curves touches a same side of said workpiece.

8. A method for producing a fixture as in claim 1, wherein said forming of said first opening comprises forming a four-sided opening.

9. A method for producing a fixture as in claim 1, wherein said step of supplying said disk of material comprises forming said disk of one of plastic, polyvinyl chloride and metal.

* * * * *